United States Patent [19]

Yamaguchi et al.

[11] 4,407,848

[45] Oct. 4, 1983

[54] PROCESS FOR DURABLY MODIFYING A SHAPED SYNTHETIC POLYMER ARTICLE

[75] Inventors: Taturo Yamaguchi, Ikeda; Norihiro Minemura, Takatsuki, both of Japan

[73] Assignee: Teijin Limited, Osaka, Japan

[21] Appl. No.: 158,731

[22] Filed: Jun. 12, 1980

[30] Foreign Application Priority Data

Jun. 26, 1979 [JP] Japan ..... 54/79613

[51] Int. Cl.[3] ..... B05D 3/06; B05D 3/02

[52] U.S. Cl. ..... 427/36; 252/8.6; 252/8.7; 252/8.8; 252/8.9; 427/44; 427/258; 427/284; 427/285; 427/288; 427/377; 427/389.9; 427/393.1; 427/393.2; 427/393.3; 427/393.4

[58] Field of Search ..... 427/54.1, 393.1, 393.2, 427/393.3, 393.4, 44, 36, 412, 258, 284, 285, 288, 389.9, 377; 8/115.6, 115.5; 252/8.6, 8.8, 8.7, 8.9

[56] References Cited

U.S. PATENT DOCUMENTS

| | | | |
|---|---|---|---|
| 3,561,996 | 2/1971 | Young | 427/412 X |
| 3,706,594 | 12/1972 | Wasley et al. | 427/393.4 X |
| 4,065,598 | 12/1977 | Takahashi et al. | 427/393.1 X |
| 4,072,776 | 2/1978 | Linke et al. | 427/393.3 |

FOREIGN PATENT DOCUMENTS 2458959 6/1975 Fed. Rep. of Germany .

*Primary Examiner*—Thurman K. Page

*Attorney, Agent, or Firm*—Burgess, Ryan & Wayne

[57] ABSTRACT

A shaped synthetic polymer article having an enhanced desired function is prepared by preparing a shaped synthetic polymer article in which at least the peripheral surface portion of said article contains 0.1% or more, based on the weight of said shaped article, of a compound (A) having, per molecule thereof, at least one unsaturated radical of the formula (I):

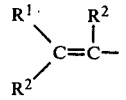

(I)

wherein $R^1$, $R^2$ and $R^3$ respectively denote, independently from each other, a hydrogen atom or an organic radical, and; by copolymerizing the compound (A) contained in the shaped article, with at least one compound (B) which has, per molecule thereof, at least one unsaturated radical of the above-mentioned formula (I) and at least one other functional radical capable of imparting a desired function to the shaped article.

12 Claims, No Drawings

PROCESS FOR DURABLY MODIFYING A SHAPED SYNTHETIC POLYMER ARTICLE

FIELD OF THE INVENTION

The present invention relates to a process for modifying a shaped synthetic polymer article. More particularly, the present invention relates to a process for improving various functions of a shaped synthetic polymer article, the improved functions thereof exhibiting an excellent durability.

BACKGROUND OF THE INVENTION

Heretofore, various methods for modifying various properties, for example, anti-static, perspiration-absorbing, anti-soiling, water-absorbing, moisture-absorbing, water-repellent, oil-repellent, anti-pilling, anti-snagging, anti-flaming, anti-melting and antibacterial properties, of shaped synthetic polymer articles, for example, synthetic polymer films and fibers, by using various modifying agents, are known. However, in the conventional methods, the modifying agents adhere to only the peripheral surface of the shaped articles. Therefore, the adhered modifying agents are not durable and, consequently, easily removed from the peripheral surface of the shaped articles by washing, laundering or dry cleaning.

Under the above-mentioned circumstances, it is strongly desired by the industry to provide a process for durably modifying a shaped synthetic polymer article, the modified property of the shaped article exhibiting an excellent durability.

SUMMARY OF THE INVENTION

An object of the present invention is to provide a process for durably modifying a shaped synthetic polymer article, which process is capable of imparting various functions having an excellent durability to the shaped article.

The above-mentioned object can be attained by the process of the present invention which comprises the steps of:

preparing a shaped synthetic polymer article in which at least the peripheral surface portion of said article contains 0.1% or more, based on the weight of said shaped article, of a compound (A) having, per molecule thereof, at least one unsaturated radical of the formula (I):

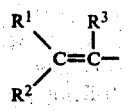

(I)

wherein $R^1$, $R^2$ and $R^3$ respectively denote, independently from each other, a hydrogen atom or an organic radical, and;

copolymerizing said compound (A) contained in said shaped article, with at least one compound (B) which has, per molecule thereof, at least one unsaturated radical of the above-mentioned formula (I) and at least one other functional radical capable of imparting a desired function to said shaped article.

DETAILED DESCRIPTION OF THE INVENTION

The term "shaped synthetic polymer article" used herein refers to a shaped article made of at least one synthetic polymer, for example, a polyester, polyamide or acrylonitrile polymer. The shaped article may be in any form: filaments, fibers, a film, a sheet, a plate or other form. Especially, in the present invention, it is preferable that the shaped article is in the form of filaments, selected from the group consisting of staple fibers, multi-filaments and a monofilament or a film. The filaments or fibers may be in any form: a spun yarn, a multifilament yarn, a textured multifilament yarn, a woven fabric, a knitted fabric, a non-woven fabric or net.

Also, it is preferable that the shaped article consists of a polyester which consists of an aromatic dicarboxylic acid component, for example, terephthalic acid, isophthalic acid, naphthalene dicarboxylic acid, diphenyldicarboxylic acid, diphenylsulphonedicarboxylic acid, diphenoxyethanedicarboxylic acid, diphenyletherdicarboxylic acid, methyl terephthalic acid, or methylisophthalic acid, and a glycol component, for example, ethyleneglycol, trimethyleneglycol, tetramethyleneglycol, neopentyleneglycol, hexamethyleneglycol, decamethyleneglycol, cyclohexanedimethylol, 2,2-bis($\beta$-hydroxyethoxyphenyl)propane, hydroquinone or 2,2-bis(hydroxyphenyl)propane. The preferable polyester consists of terephthalic acid and ethylene glycol or tetramethyleneglycol.

The aromatic dicarboxylic acid component may be used together with 30% or less, preferably 20% or less, based on the molar amount of the mixture, of at least one member selected for aliphatic dicarboxylic acids, for example, succinic acid, adipic acid and sebacic acid; alicyclic dicarboxylic acids, for example, hexahydroterephthalic acid, and; oxycarboxylic acids, for example, $\epsilon$-hydroxycaproic acid, hydroxybenzoic acids, and hydroxyethoxybenzoic acids.

The shaped article may contain any additive, for example, an ultraviolet ray-absorber, an anti-oxidant, a pigment, an optical brightening agent and delustering agent, unless the additives hinder the effect of the present invention. The compound (A) has, per molecule thereof, at least one unsaturated radical of formula (I):

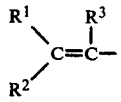

(I)

wherein $R^1$, $R^2$ and $R^3$, which may be the same as or different from each other, respectively denote a hydrogen atom or an organic radical, which may be a substituted or an unsubstituted aromatic, aliphatic or alicyclic radical, preferably, an alkyl radical having 1 to 3 carbon atoms. It is preferable that the unsaturated radical of the formula (I) is selected from the group consisting of allyl, methallyl and crotyl radicals.

The compound (A) can be selected from the group consisting of compounds (a) in which the unsaturated radical of the formula (I) is attached to a nitrogen atom, for example, styrene, vinyltoluene, allyl cinnamate, allyl phenol, allyl phenylether, allyl glycidylether, sodium p-styrenesulfonate, diallyl phthalate, diallyl terephthalate, diallyl isophthalate, N,N'-diallyl pyromellitimide N,N'-dimethallyl pyromellitimide, N,N'-dicrotyl pyromellitimide, N,N'-diallylbenzophenone-3,4,3',4'-tetracarboxylic acid bis-imide, N,N'-dimethallylbenzophenone-3,4,3',4'-tetracarboxylic acid bis-imide, N,N'-dicrotylbenzophenone-3,4,3',4'-tetracarboxylic acid bis-imide, N,N'-diallylbutane-1,2,3,4-tetracarboxylic acid bis-imide, N,N'-dimethallylbutane-1,2,3,4-tetracarboxylic acid bis-imide, N,N'-dicrotylbutane-1,2,3,4-tetracarboxylic acid bis-imide, N,N'-diallylbenzamide, N,N'-dimethallylbenzamide, N,N'-dicrotylbenzamide, N,N'-diallylterephthalamide, N,N'-dimethallylterephthalamide, N,N'-dicrotylterephthalamide, N,N'-diallylisophthalamide, N,N'-dimethallylisophthalamide, N,N'-dicrotylisophthalamide, N,N'-diallyladipamide, N,N'-dimethallyladipamide, N,N'-dicrotyladipamide, N,N,N',N'-tetraallylisophthalamide, N,N,N',N'-tetramethallylisophthalamide, N,N,N',N'-tetracrotylisophthalamide, N,N',N''-triallyltrimesic acid amide, N,N',N''-trimethallyltrimesic acid amide, N,N',N''-tricrotyltrimesic acid amide, N,N,N',N',N'',N''-hexallyltrimesic acid amide, N,N,N',N',N'',N''-hexamethallyltrimesic acid amide, N,N,N',N',N'',N''-hexacrotyltrimesic acid amide, N,N'-diallyltrimellitamideimide, N,N'-dimethallyltrimellitamideimide, N,N'-dicrotyltrimellitamideimide, N,N,N'-trimethallyltrimellitamideimide, N,N,N'-tricrotyltrimellitamideimide, ethylene-bis(N-allyltrimellitic acid imide), hexamethylene-bis(N-allyltrimellitic acid imide)amide, dodecamethylene-bis(N-methallyl trimellitic acid imide)amide, the compounds of the formula:

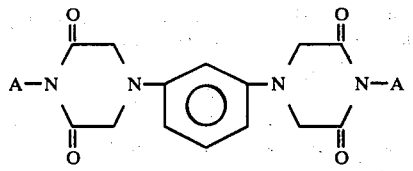

wherein A represents a member selected from allyl, methallyl and crotyl radicals, triallyl isocyanurate, trimethallyl isocyanurate tricrotyl isocyanurate, tetrallyl urea, tetramethallyl urea and tetracrotyl urea, and; another compound (b) in which the unsaturated radical of the formula (I) is attached to an oxygen atom, for example, ethyleneglycol bis-allylether, ethyleneglycol bis-methallylether, ethyleneglycol bis-crotylether, tetramethyleneglycol bis-allylether, tetramethyleneglycol bis-methallylether, tetramethyleneglycol bis-crotylether, neopentyleneglycol bis-allylether, neopentyleneglycol bis-methallylether, neopentyleneglycol bis-crotylether, triallyloxypropane, trimethallyloxypropane, tricrotyloxypropane, tetrakisallyloxymethylmethane, tetrakismethallyloxymethylmethane, tetrakiscrotyloxymethylmethane, triallyl cyanurate, trimethallyl cyanurate and tricrotyl cyanurate.

The shaped synthetic polymer article in which at least the peripheral surface portion thereof contains 0.1% or more, based on the weight of the shaped article, of the component (A), can be prepared by absorbing the compound (A) by the shaped portion. In this case, the absorbed component (A) is mainly distributed in the peripheral surface portion of the shaped article. In order to promote the absorption of the compound (A) and enhance the anchoring effect of the compound (A), it is preferable that the compound (A) has a small molecular weight and be provided with a lipophilic (hydrophobic) radical in the molecule thereof.

The absorption procedure can be carried out at any stage during or after the shaping procedure for the synthetic polymer material. For example, when a melt of the synthetic polymer is converted into solid filaments by a melt-spinning method, a spinning oil containing the compound (A) is applied to the solid filaments so as to allow the compound (A) to be absorbed by the solid filaments. Also, when the filaments are drawn, an oiling agent containing the compound (A) is applied to the filament so as to allow the filaments to absorb the compound (A). The compound (A) may be applied together with a sizing agent, knitting oil, dye or finishing agent, to the shaped article.

When the compound (A) is absorbed by the shaped article, it is preferable that the absorbed compound (A) is in an amount of 0.1% or more, more preferably, 0.5% or more, still more preferably, 1.0% or more, based on the weight of the shaped article. When the amount of the absorbed compound (A) is less than 0.1%, the resultant modified shaped article cannot exhibit a satisfactory intensity of the desired function and durability in the function. Also, it is unnecessary that the compound (A) is absorbed in an amount of more than 20% based on the weight of the shaped article because the portion of the absorbed compound (A) exceeding 20% is not effective for increasing the intensity and durability of the desired function.

The incorporation of the compound (A) into the shaped material may be carried out in such a manner that the compound (A) is uniformly mixed with a synthetic polymer, and, then the compound (A)-containing synthetic polymer is shaped to prepare the shaped article. In this manner, it is preferable that the compound (A) is mixed in an amount of from 0.1 to 40%, more preferably, 0.5 to 20%, still more preferably, 1.0 to 10%, based on the weight of the synthetic polymer.

The mixing procedure of the compound (A) into the synthetic polymer can be by any conventional method. For example, the compound (A) may be added to a polymerization mixture from which the synthetic polymer will be produced. Also, the compound (A) may be mixed with a melt of the synthetic polymer to prepare a melt mixture from which a desired shaped article, for example, fibers or film will be produced.

The shaped synthetic polymer article containing therein the compound (A) is subjected to a copolymerization procedure of the compound (A) with the compound (B).

The compound (B) has, per molecule thereof, at least one unsaturated radical of the above-mentioned formula (I) and at least one other functional radical capable of imparting, to the shaped article, a desired function which may include one or more of, for example, antistatic, perspiration-absorbing, anti-soiling, water-absorbing, moisture-absorbing, water-repellent, oil-repellent, anti-pilling, anti-snagging, anti-flaming, anti-melting, anti-bacterial, bonding property-enhancing and dyeing property enhancing functions.

In order to impart at least one function selected from antistatic, perspiration-absorbing, anti-soiling, water-absorbing, moisture-absorbing and/or hydrophilic property enhancing functions, to said shaped article, it is preferable that the compound (B) is selected from the group consisting of acrylic acid, methacrylic acid, acrylamide, methacrylamide, N-methylolacrylamide, monopolyethyleneglycol acrylate, monopolyethyleneglycol methacrylate, monopolyethyleneglycoltrimethylammonium acrylate and methacrylate, acryloxyethylammonium chloride, acryloxyethyldimethylbenzylammonium chloride, monoethyleneglycolphosphonium acrylate and methacrylate, methoxypolyethyleneglycol acrylate and methacrylate, polyoxyethyleneglycol acrylate and methacrylate, and the compounds of the formula:

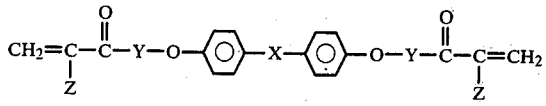

wherein X represents a member selected from the radicals of the formulae,

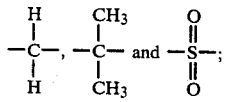

Y represents a member selected from the radicals of the formulae, $$-(CH_2CH_2O)_n- \text{ and}$$

$$-(CH_2\overset{CH_3}{\overset{|}{C}}H-O)_m(CH_2CH_2O)_n$$

in which n denotes an integer of from 5 to 50 and m denotes an integer of from 1 to 20; and Z represents a member selected from hydrogen atom and methyl radical.

In order to impart at least one function selected from the water-repellent and oil repellent functions to the shaped article, it is preferable that the compound (B) is selected from the organic fluorine compounds of the formulae, $$CH_2=CH-O-CH_2(CF_2)_6CF_3$$

-continued and $$CH_2=\overset{CH_3}{\overset{|}{C}}-O-CH_2(CF_2)_6CF_3$$

In order to impart at least one function selected from the anti-flaming and anti-melting functions to the shaped article, it is preferable that the compound (B) is selected from the compounds of the formulae;

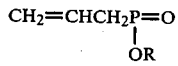

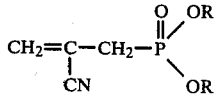

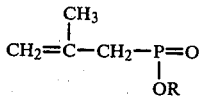

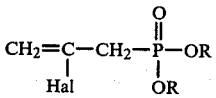

and

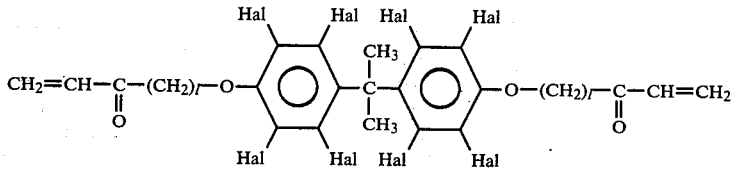

wherein R represents a member selected from the group consisting of alkyl radicals having 1 to 4 carbon atoms and a benzene ring, Hal represents a member selected from the group consisting of bromine and chlorine atoms, and l represent an integer of from 1 to 4.

In order to impart an antibacterial function to the shaped article, it is preferable that the compound (B) is selected from the group consisting of monoethyleneglycoltrimethylammonium chloride acylate and methacrylate, dimethyl-benzylammonium chloride acrylate and methacrylate, and the compounds of the formulae:

$$CH_2=CHCOC_2H_4Sn-(CH_3)_3$$

and $$CH_2=\overset{CH_3}{\overset{|}{C}}-COC_2H_4Sn-(CH_3)_3$$

In the copolymerization procedure, the compound (B) is usually used in an amount of from 0.05 to 20%, preferably, from 0.1 to 15%, and more preferably, from 0.5 to 10%, based on the weight of the shaped article.

The copolymerization procedure can be carried out by immersing the shaped article containing the compound (A) in a solution of the compound (B), or coating or spraying the solution onto the shaped article containing the compound (A). The solution can be prepared by dissolving the compound (B) in a solvent consisting of, for example, water or acetone. Usually, water is used as the solvent for the compound (B), and the copolymerization is effected by an immersing method. The copolymerization of the compound (A), contained in the shaped article, with the compound (B) can be initiated by using any initiating method, for example, by applying actinic rays such as gamma rays or an electron beam to the copolymerization system, by oxidizing the copolymerization system by a electrolytic oxidation method or by using ozone, or by adding an initiating agent such as, for example, hydrogen peroxide, persulfate compounds, benzoyl peroxide, or ago-his-isobutylonitrile. Preferably, the initiation is carried out by using actinic rays or an initiating agent such as benzoyl peroxide and persulfate compounds. Usually, the copolymerization is carried out at a temperature of from 20° to 180° C. for 1 to 60 minutes. Also, the copolymerization may be carried out in an air atmospherer. However, it is preferable that the copolymerization is carried out in an inert gas atmosphere, for example, nitrogen gas atmosphere and carbon dioxide gas atmosphere, or in a saturated steam atmosphere at a temperature of from 20° to 150° C.

As a result of the copolymerization, a function-imparting polymer, in which the compound (B) is bonded with the compound (A) contained in the shaped article by a covalent bond, is produced in and on the shaped article. The resultant polymer exhibits an excellent fastness to washing, laundering, dry cleaning and rubbing due to the anchor effect of the compound (A). Therefore, the modified shaped article of the present invention is useful for the uses of clothing and industrial materials.

The specific examples presented below will serve to more fully explain how the present invention is practiced. However, it will be understood that these examples only illustrate and in no way limit the scope of the present invention.

In the examples, the intensities of certain functions of the resultant modified shaped articles were determined by the following method.

WICKING FUNCTION (Water-absorbing rate)

A specimen of a fabric made from modified fibers was tightly fixed on a frame having a length of 30 cm and a width of 15 cm. A burette which was capable of releasing water in small quantities, in this case 26 to 27 drops per ml, was placed above the specimen on the frame which was supported horizontally. The distance between the lower end of the burette and the upper surface of the specimen was 2 cm. When a drop of distilled water from the burette reached the specimen surface, a stop watch was started for a timing operation, and stopped when the drop of water was completely absorbed by the specimen, so that the portion of the specimen which absorbed the drop of water, exhibited no specific reflection of visible light, which reflection was derived from a layer of water not absorbed by the specimen.

ANTI-STATIC FUNCTION (Half-value period)

Two specimens of a fabric made of modified fibers, each having a warp length of 5 cm and weft length of 4.5 cm, were conditioned in a conditioning atmosphere at a temperature of 20° C. at a relative humidity (RH) of 50%. One of the conditioned specimens was placed on the other and the superimposed specimens were fixed on a turn table of a Static Honestmeter. A voltage of 10,000 volts was applied to the specimens through a needle electrode, and the turn table was rotated at a speed of 1730 rpm for 20 minutes. When the turning operation for 20 minutes was completed, the application of the voltage of 10,000 volts was stopped and the time necessary for decreasing the charge on the specimens to a value corresponding to one half of the original charge of the specimens, was measured. The measurement was carried out in a conditioned atmosphere at a temperature of 20° C. at a relative humidity of 50%.

WATER-REPELLENT FUNCTION

A specimen of a fabric made of modified fibers was tightly fixed on a cylindrical frame having a diameter of 15.2 cm, 250 ml of water were sprayed on the specimen in such a manner that the center line of the spray laid on the longitudinal axis of the cylindrical frame, while allowing drops of water formed on the surface of the specimen to fall down from the surface. The wetted surface of the specimen was evaluated by using an evaluating standard. When the surface of the specimen was completely wetted, the water-repellent function of the specimen was evaluated at zero. When the surface of the specimen was completely not wetted, the water-repellent function of the specimen was evaluated at 100.

OIL-REPELLENT FUNCTION

This function was measured in accordance with AATCC Test Method 118-1975.

ANTI-FLAMING FUNCTION

This function was measured in accordance with Japanese Industrial Standard L-1091-1971, microburner method. The intensity of the anti-flaming function was expressed by residual flaming time (seconds) and by the area ($cm^2$) of the carbonized portion of the specimen. The smaller the residual flaming time and the area of the carbonized portion, the more superior the anti-flaming function of the specimen.

DURABILITY

A specimen which had not yet been laundered was evaluated at $L_0$. When a specimen was continuously laundered with an aqueous solution containing 1 g/l of neutral detergent at a temperature of 40° C. for 100 minutes by using a home washing machine, the laundered specimen was evaluated at $L_{100}$. Also, when a specimen was laundered in the same manner as that mentioned above, except for the continuous laundering time of 300 minutes, the laundered specimen was evaluated at $L_{300}$. Each of the specimens $L_0$, $L_{100}$ and $L_{300}$ were subjected to desired function tests.

EXAMPLES 1 THROUGH 3 AND COMPARISON EXAMPLE 1

In Each of the Examples 1 through 3, taffeta having a weight of 60 g/$m^2$ was woven from polyethylene terephthalate multifilaments having a yarn count of 75 denier/36 filaments, scoured and, then, preset at a temperature of 80° C. The taffeta was immersed in a treating aqueous solution containing 5%, based on the weight of the taffeta, of the compound (A) specified in Table 1, 1 g/l of dispersing agent (the trademark of which was Disper VG and which was made by Meisei Kagaku, Japan) and 0.2 ml/l of 99% acetic acid, at a temperature of 130° C. and a liquor ration of 1:30, for 45 minutes.

The taffeta was removed from the treating solution, and rinsed with water. The treated taffeta which absorbed the compound (A), was dipped in an aqueous solution containing 8.0 parts by weight of the compound (B) of the formula:

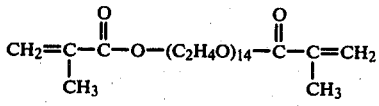

0.2 parts by weight of potassium persulfate and 91.8 parts by weight of water and, then, uniformly squeezed by using a mangle, to an extent that the solution was retained in an amount corresponding to 41% of the weight of the taffeta, in the taffeta.

The squeezed taffeta, which was in wetted condition, was placed in a steamer and treated with saturated steam at a temperature of 100° C. for 5 minutes. Thereafter, the taffeta was washed with hot water to remove the non-reacted compound (B), and finally, dried.

The intensity of the anti-static function of the resultant modified taffeta was measured.

In Comparison Example 1, the same procedures as those mentioned above were carried out, except that no compound (A) was used.

The results are indicated in Table 1.

TABLE 1

| Example No. | Compound (A) Type | Compound (A) Absorbed amount (% by wt.) | Anti-static function (Half-value period, second) $L_0$ | $L_{100}$ | $L_{300}$ |
|---|---|---|---|---|---|
| Example 1 | Diallyl phthalate | 4.7 | 0.6 | 2.1 | 5.2 |
| Example 2 | Diallyl glycidyl ether | 4.5 | 0.7 | 2.4 | 5.7 |
| Example 3 | Triallyl isocyanurate | 4.4 | 0.7 | 2.8 | 6.1 |
| Comparison Example 1 | none | 0 | 0.9 | 24.2 | 60< |

EXAMPLES 4 THROUGH 7 AND COMPARISON EXAMPLE 2

In each of the Examples 4 through 7 and Comparison Example 2, the same procedures as those mentioned in Example 1 were carried out, except that the component (A) consisting of diallyl phthalate was absorbed in an amount indicated in Table 2 by the polyethylene terephthalate filament taffeta.

The results are indicated in Table 2.

TABLE 2

| Example No. | Amount of Compound (A) absorbed (% by wt.) | Anti-static function (Half value period, second) $L_0$ | $L_{100}$ | $L_{300}$ |
|---|---|---|---|---|
| Comparison Example 2 | 0.05 | 0.9 | 20.1 | 60< |
| Example 4 | 0.12 | 0.8 | 5.9 | 24.7 |
| Example 5 | 0.6 | 0.8 | 4.8 | 15.1 |
| Example 6 | 1.1 | 0.7 | 2.9 | 5.9 |
| Example 7 | 14 | 0.6 | 2.3 | 5.2 |

EXAMPLE 8 AND COMPARISON EXAMPLE 3

A polyethylene terephthalate multifilament yarn having a yarn count of 75 denier/36 filaments was textured by a false-twisting method. The textured yarn was converted into a pongee fabric. The pongee fabric was scoured and, then, preset at a temperature of 80° C. for 10 minutes.

In Example 8, the preset pongee fabric was subjected to the same compound (A)-absorbing procedures as mentioned in Example 1. Thereafter the compound (A)-absorbed pongee fabric was subjected to the same copolymerization procedures as those described in Example 1, except that the compound (B) was of the formula:

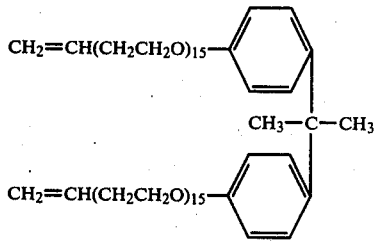

This compound was effective for imparting an excellent anti-static function to the pongee fabric. Also, the squeezing procedure was carried out to an extent that the compound (A)-absorbed pongee fabric was impregnated with a solution of the compound (B) in an amount corresponding to 69% of the weight of the pongee fabric.

In Comparison Example 3, procedures identical to those mentioned in Example 8 were carried out, except that no compound (A) was used.

The intensities and durabilities of the anti-static functions of the modified pongee fabrics of Example 8 and Comparison Example 3 are indicated in Table 3.

TABLE 3

| Example No, | Anti-static function (Half-value period, sec.) $L_0$ | $L_{100}$ | $L_{300}$ | Wicking function (Water-absorbing rate, sec.) $L_0$ | $L_{100}$ | $L_{300}$ |
|---|---|---|---|---|---|---|
| Example 8 | 0.3 | 1.0 | 2.4 | 0.7 | 2.4 | 8.9 |
| Comparison Example 3 | 0.4 | 3.7 | 18.4 | 1.1 | 5.0 | 180< |

EXAMPLE 9 AND COMPARISON EXAMPLE 4

In Example 9, the same procedures as described in Example 8 were carried out, except that the compound (A) used was of the formula:

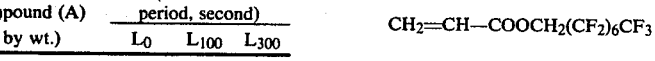

$$CH_2{=}CH{-}COOCH_2(CF_2)_6CF_3$$

which compound is effective for imparting water-repellent and oil-repellent functions to the shaped article.

In Comparison Example 4, the same procedures as those described in Example 9 were carried out, except that no component (A) was used.

The intensities and durabilities of the water- and oil-repellent functions of the modified pongee fabrics of Example 9 and Comparison Example 4 are indicated in Table 4.

TABLE 4

| No. | Water-repellent function (point) $L_0$ | $L_{100}$ | $L_{300}$ | Oil-repellent function (class) $L_0$ | $L_{100}$ | $L_{300}$ |
|---|---|---|---|---|---|---|
| Example 9 | 100 | 100 | 100 | 7 | 7 | 6 |
| Comparison Example 4 | 100 | 80 | 50 | 7 | 5 | 3 |

EXAMPLE 10 AND COMPARISON EXAMPLE 5

In Example 10, the same procedures as described in Example 8 were carried out, except that the compound (A) used was of the formula:

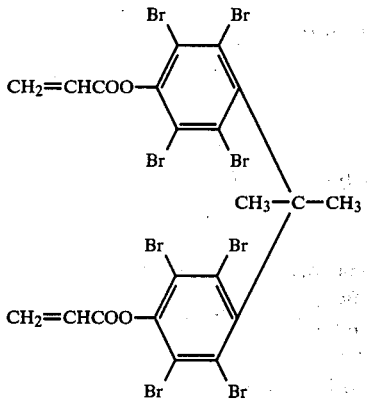

which is effective for imparting an excellent anti-flaming function to the shaped article.

In Comparison Example 5, the same procedures as those described in Example 10 were carried out, except that no compound (A) was used.

The intensities and durabilities of the anti-flaming function of the pongee fabrics of Example 10 and Comparison Example 5 are indicated in Table 5.

TABLE 5

| Example No. | Residual flaming time (sec.) $L_0$ | $L_{100}$ | $L_{300}$ | Area of carbonized portion of fabric $L_0$ | $L_{100}$ | $L_{300}$ |
|---|---|---|---|---|---|---|
| Example 10 | 0 | 0 | 3 | <10 | <10 | <30 |
| Comparison Example 5 | 0 | 0 | >3 | <10 | <30 | <45 |

EXAMPLES 11 THROUGH 17 AND COMPARISON EXAMPLES 6 AND 7

In each of Examples 11 through 17 and Comparison Examples 6 and 7, polyethylene terephthalate pellets having a limiting viscosity of 0.64 were dried and mixed with an amount as indicated in Table 6 of a compound (A) of the formula:

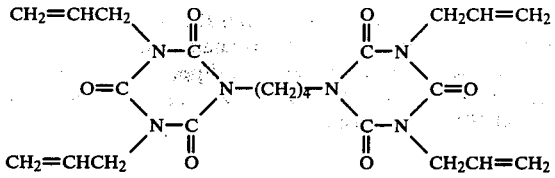

by using a mixing machine. The mixture was melted and extruded at a temperature of 280° C. by using a biaxial extruder, to prepare polyester pellets containing the compound (A). The polyester pellets were dried by an ordinary drying method and, then, melted and extruded through a spinneret having 48 spinning holes, each having a diameter of 0.3 mm, at a temperature of 290° C. at an extruding rate of 80 g/min. The extruded filamentary streams of the polyester-compound (A) mixture were solidified by cooling them and wound on a winding drum at a speed of 1500 m/min. The polyester filaments were drawn at a draw ratio of 3.2 and a temperature of 85° C. to provide a polyester filament yarn containing the compound (A) and having a yarn count of 150 denier/48 filament.

The filaments yarn was converted into a taffeta having a weight of 80 g/m$^2$. The taffeta was scoured and preset at a temperature of 80° C. for 10 minutes.

The preset taffeta was subjected to the same copolymerization procedures as those described in Example 1.

The intensities and durabilities of the antistatic functions of the modified taffetas are indicated in Table 6.

TABLE 6

| Example No. | Amount of component (A) (% by wt) | Filament yarn: Tensile strength (g/d) | Filament yarn: ultimate elongation (%) | Anti-static function (Half-vulve period) $L_0$ | $L_{100}$ | $L_{300}$ |
|---|---|---|---|---|---|---|
| Comparison Example 6 | 0 | 4.93 | 28.9 | 0.9 | 20.6 | 60< |
| Comparison Example 7 | 0.05 | 4.91 | 29.2 | 0.9 | 20.1 | 60< |
| Example 11 | 0.12 | 4.90 | 29.4 | 0.9 | 13.4 | 47.0 |
| Example 12 | 0.6 | 4.88 | 30.1 | 0.8 | 6.7 | 20.2 |
| Example 13 | 1.2 | 4.86 | 30.3 | 0.7 | 2.8 | 5.9 |
| Example 14 | 9.0 | 4.83 | 30.6 | 0.7 | 2.6 | 5.1 |
| Example 15 | 18 | 4.80 | 31.3 | 0.7 | 2.4 | 5.0 |
| Example 16 | 38 | 4.61 | 33.4 | 0.7 | 2.4 | 5.2 |
| Example 17 | 42 | 3.91 | 19.7 | 0.7 | 2.0 | 5.1 |

EXAMPLES 18 THROUGH 25

In each of Examples 18 through 25, the same procedures as those described in Example 11 were carried out, except that the component (A) as indicated in Table 7 was used in an amount of 3.0% by weight.

The results are indicated in Table 7.

TABLE 7

| Example No. | Compound (A) | $L_0$ | $L_{100}$ | $L_{300}$ |
|---|---|---|---|---|
| 18 | Triallyl isocyanurate | 0.7 | 2.6 | 5.6 |
| 19 | N—phenyl-N',N''—diallyl isocyanurate | 0.6 | 2.1 | 4.8 |
| 20 | N,N'—dicrotyl pyromellitimide | 0.7 | 2.7 | 6.2 |
| 21 | Diallylamineterephthalamide | 0.8 | 3.0 | 7.1 |
| 22 | Tetrallyl urea | 0.7 | 2.9 | 6.4 |
| 23 | Dimethallyl termellitic acid amide | 0.8 | 3.1 | 5.8 |
| 24 | $(*)_1$ | 0.7 | 2.2 | 4.9 |

TABLE 7-continued

| Example No. | Compound (A) | $L_0$ | $L_{100}$ | $L_{300}$ |
|---|---|---|---|---|
| 25 | (*)2 | 0.7 | 2.5 | 5.8 |

Note (*)1

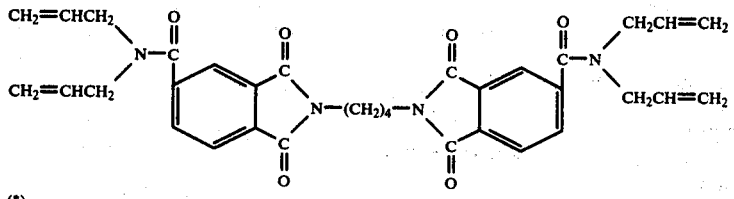

(*)2

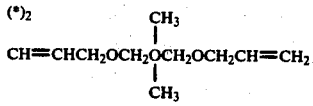

EXAMPLE 26 AND COMPARISON EXAMPLE 8

In Example 26, the same procedures for preparing the polyester filament yarn containing the compound (A) as those described in Example 11 were carried out, except that the compound A was used in an amount of 2% by weight. The polyester filament yarn was textured by a false-twisting method. The textured yarn was converted into a pongee fabric. The pongee scoured and, then, preset at a temperature of 80° C. for 10 minutes.

The preset pongee fabric was subjected to the same copolymerization procedures as those described in Example 8, except that the squeezed fabric contained the compound (B) solution in an amount corresponding to 67% of the weight of the pongee fabric. The compound (B) used was of the formula:

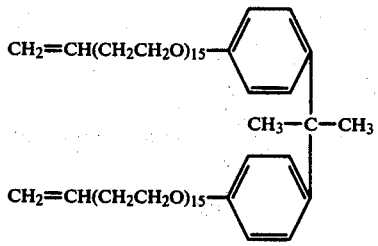

In comparison Example 8, the same procedures as those mentioned in Example 26 were carried out, except that, no compound (A) was used.

The results are indicated in Table 8.

TABLE 8

| Example No. | Anti-static function (Half-value period, sec.) | | | Wicking function (Water-absorbing rate, sec.) | | |
|---|---|---|---|---|---|---|
| | $L_0$ | $L_{100}$ | $L_{300}$ | $L_0$ | $L_{100}$ | $L_{300}$ |
| Example 26 | 0.3 | 1.2 | 2.9 | 0.8 | 2.5 | 96 |
| Comparison Example 8 | 0.4 | 3.4 | 20.9 | 1.0 | 4.8 | 180< |

EXAMPLE 27 AND COMPARISON EXAMPLE 9

In Example 27, the same procedures as those described in Example 26 were carried out, except that the compound (B) was of the formula:

$CH_2{=}CHCOOCH_2(CF_2)_6CF_3$

In Comparison Example 9, the same procedures as those described in Example 27 were carried out, except that no compound (A) was used.

The results are indicated in Table 9.

TABLE 9

| Example No. | Water-repellent function (point) | | | Oil-repellent function (class) | | |
|---|---|---|---|---|---|---|
| | $L_0$ | $L_{100}$ | $L_{300}$ | $L_0$ | $L_{100}$ | $L_{300}$ |
| Exmple 27 | 100 | 100 | 80 | 7 | 7 | 5 |
| Comparison Example 9 | 100 | 80 | 50 | 7 | 5 | 3 |

EXAMPLE 28 AND COMPARISON EXAMPLE 10

In Example 28, the same procedures as those described in Example 26 were carried out, except that the compound (B) was of the formula:

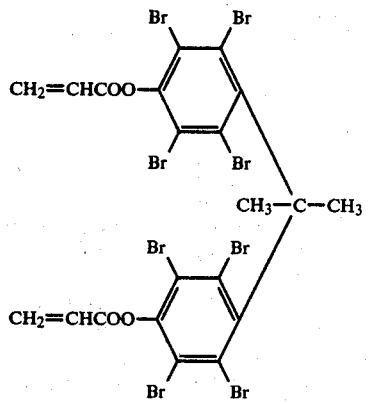

In Comparison Example 10, the same procedures as those described in Example 28 were carried out, except that no compound (A) was used.

The results are indicated in Table 10.

TABLE 10

| Example No. | Anti-flaming function: Residual flaming time (sec.) | | | Area of carbonized portion of fabric (cm) | | |
|---|---|---|---|---|---|---|
| | $L_0$ | $L_{100}$ | $L_{300}$ | $L_0$ | $L_{100}$ | $L_{300}$ |
| Example 28 | 0 | 0 | 3 | <10 | <10 | <30 |
| Comparison | 0 | 3 | >3 | <10 | <30 | >45 |

TABLE 10-continued

| Example No. | Anti-flaming function: Residual flaming time (sec.) $L_0$ | $L_{100}$ | $L_{300}$ | Area of carbonized portion of fabric (cm) $L_0$ | $L_{100}$ | $L_{300}$ |
|---|---|---|---|---|---|---|
| Example 10 | | | | | | |

We claim:

1. A process for durably modifying a shaped synthetic polymer article, comprising the steps of:

applying, onto at leat a peripheral surface portion of a shaped synthetic polymer article, 0.1 percent to 40 percent, based on the weight of said shaped article, of the compound diallyl phthalate then applying 0.05 percent to 20 percent, based on the weight of said shaped article, of the compound polyoxyethyleneglycolacrylate, which is capable of imparting at least one function selected from the group consisting of anti-static, perspiration-absorbing, anti-soiling, water-absorbing, moisture-absorbing, water-repellent, oil-repellent, anti-pilling, anti-snagging, anti-flaming, anti-melting, anti-bacterial, bonding property-enhancing and dyeing property-enhancing to said shaped article; and copolymerizing said compounds in said shaped article.

2. A process as claimed in claim 1, wherein said diallyl phthalate is absorbed in said peripheral surface portion of said shaped article.

3. A process as claimed in claim 1, wherein said diallyl phthalate is uniformly mixed in said synthetic polymer and, then, said synthetic polymer is shaped to prepare said shaped article.

4. A process as claimed in claim 1, wherein said synthetic polymer is selected from the group consisting of polyesters, polyamides and acrylonitrile polymers.

5. A process as claimed in claim 1, wherein said shaped article is in the form selected from the group consisting of staple fibers, multi-filaments, monofilaments and films.

6. A process as claimed in claim 1, further comprising a compound capable of imparting a water-repellent and/or oil-repellent function to said shaped article, of the formulae, $$CH_2{=}CH{-}O{-}CH_2(CF_2)_6CF_3$$

and $$CH_2{=}\overset{\overset{\displaystyle CH_3}{|}}{C}{-}O{-}CH_2(CF_2)_6CF_3$$

7. A process as claimed in claim 1, further comprising a compound capable of imparting an anti-flaming and/or anti-melting function to said shaped article, of the formulae:

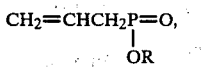

$$CH_2{=}CHCH_2\underset{\underset{\displaystyle OR}{|}}{P}{=}O,$$

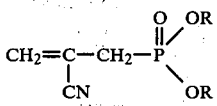

$$CH_2{=}\underset{\underset{\displaystyle CN}{|}}{C}{-}CH_2{-}P\begin{matrix}{=}O\,OR\\ OR\end{matrix}$$

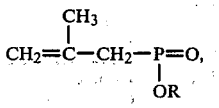

$$CH_2{=}\overset{\overset{\displaystyle CH_3}{|}}{C}{-}CH_2{-}\underset{\underset{\displaystyle OR}{|}}{P}{=}O,$$

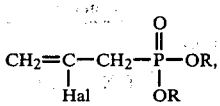

$$CH_2{=}\underset{\underset{\displaystyle Hal}{|}}{C}{-}CH_2{-}\overset{\overset{\displaystyle O}{\|}}{\underset{\underset{\displaystyle OR}{|}}{P}}{-}OR,$$

and

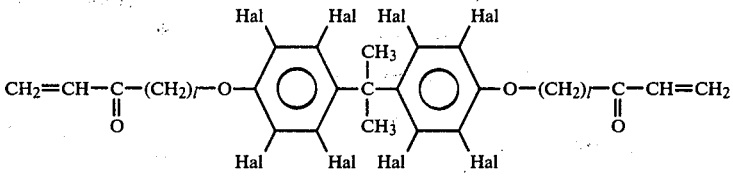

wherein R represents a member selected from the group consisting of alkyl radicals having 1 to 4 carbon atoms and benzene ring, Hal represents a member selected from the group consisting of bromine and chlorine atoms, and l represents an integer of from 1 to 4.

8. A process as claimed in claim 1, further comprising a compound capable of imparting an antibacterial function to said shaped article, and is selected from the group consisting of monoethyleneglycoltrimethylammonium chloride acrylate and methacrylate, dimethylbenzylammonium chloride acrylate and methacrylate, and the compounds of the formulae:

$$CH_2{=}CHCOC_2H_4S_n{-}(CH_3)_3$$

and $$CH_2{=}\overset{\overset{\displaystyle CH_3}{|}}{C}{-}COC_2H_4S_n{-}(CH_3)_3$$

9. A process as claimed in claim 1, wherein said copolymerization is carried out by immersing said shaped article containing said diallyl phthalate in a solution of said polyoxyethylene glycol acrylate or by coating or spraying said solution onto said shaped article containing said diallyl phthalate.

10. A process as claimed in claim 1, wherein said copolymerization of said diallyl phthalate with said polyoxyethylene glycol acrylate is initiated by applying actinic rays to the copolymerization system.

11. A process as claimed in claim 1, wherein said copolymerization of said diallyl phthalate with said polyoxyethylene glycol acrylate is initiated by adding an initiating agent to said copolymerization system.

12. A process as claimed in claim 1, wherein said copolymerization is carried out in an inert gas atmosphere or a saturated steam atmosphere.

* * * * *